US007331586B2

(12) United States Patent
Trinkner et al.

(10) Patent No.: US 7,331,586 B2
(45) Date of Patent: Feb. 19, 2008

(54) VEHICULAR STORAGE SYSTEM

(75) Inventors: Chad M. Trinkner, Neenah, WI (US); Michael R. Moore, Larsen, WI (US); Robert P. Juidici, New London, WI (US); Basil A. Briskie, Pine River, WI (US); Michael J. Massey, Oshkosh, WI (US); Randall L. Bice, Rochester, MN (US); Brian R. Meldahl, Brownsdale, MN (US); John W. Randjelovic, Appleton, WI (US)

(73) Assignee: Pierce Manufacturing Company, Appleton, WI (US)

( * ) Notice: Subject to any disclaimer, the term of this patent is extended or adjusted under 35 U.S.C. 154(b) by 467 days.

(21) Appl. No.: 10/821,634

(22) Filed: Apr. 9, 2004

(65) Prior Publication Data

US 2005/0253344 A1 Nov. 17, 2005

(51) Int. Cl.
*A62C 2/00* (2006.01)

(52) U.S. Cl. ..... 280/4; 169/24

(58) Field of Classification Search ..... 280/4; 169/24; 296/37.1, 37.7
See application file for complete search history.

(56) References Cited

U.S. PATENT DOCUMENTS

| | | | | |
|---|---|---|---|---|
| 790,839 | A | | 5/1905 | Hopkins |
| 881,872 | A | | 3/1908 | Sanford |
| 1,028,612 | A | | 6/1912 | Schneider et al. |
| 2,037,774 | A | | 4/1936 | Fox |
| 2,284,419 | A | | 5/1942 | Greig |
| 2,625,404 | A | | 1/1953 | Treiber |
| 2,953,287 | A | | 9/1960 | Werner |
| 3,406,999 | A | | 10/1968 | Kozicki |
| 3,534,892 | A | | 10/1970 | Truelove, Sr. |
| 3,878,896 | A | | 4/1975 | White |
| 4,266,821 | A | | 5/1981 | Gillet |
| 4,319,662 | A | | 3/1982 | Liston |
| 4,366,933 | A | | 1/1983 | Broussard |
| 4,429,931 | A | | 2/1984 | Brooks |
| 4,824,158 | A | | 4/1989 | Peters et al. |
| 4,830,421 | A | | 5/1989 | Hawelka et al. |
| 4,844,490 | A | * | 7/1989 | Kohler ..... 280/4 |
| 4,886,282 | A | * | 12/1989 | Wilkinson et al. ..... 280/4 |
| 4,909,558 | A | | 3/1990 | Roshinsky |
| 5,211,351 | A | | 5/1993 | DeClerck |
| 5,346,355 | A | | 9/1994 | Riemer |
| 5,560,525 | A | | 10/1996 | Grohmann et al. |
| 5,564,767 | A | | 10/1996 | Strepek |
| 5,575,521 | A | | 11/1996 | Speis |
| 5,636,648 | A | | 6/1997 | O'Brien et al. |
| 5,722,453 | A | | 3/1998 | Huxhold |
| 5,749,616 | A | | 5/1998 | Steever |
| 5,755,470 | A | | 5/1998 | Schempp |
| 5,791,696 | A | | 8/1998 | Miyajima et al. |

(Continued)

FOREIGN PATENT DOCUMENTS

| | | |
|---|---|---|
| CA | 2144717 | 9/1966 |

(Continued)

*Primary Examiner*—Tony Winner
(74) *Attorney, Agent, or Firm*—Foley & Lardner LLP

(57) ABSTRACT

A vehicle storage system for a vehicle includes an inclined guide configured to be coupled to a vehicle and a storage structure coupled to the guide and configured to move along the guide while maintaining a substantially horizontal orientation.

48 Claims, 9 Drawing Sheets

U.S. PATENT DOCUMENTS

| | | | |
|---|---|---|---|
| 5,871,240 | A | 2/1999 | Miyajima et al. |
| 5,897,154 | A | 4/1999 | Albertini et al. |
| 5,964,492 | A | 10/1999 | Lyon |
| 5,988,559 | A | 11/1999 | Gnass |
| 6,006,841 | A | 12/1999 | Hunke |
| 6,015,177 | A | 1/2000 | Tijerina |
| 6,035,940 | A | 3/2000 | Bourke |
| 6,158,670 | A | 12/2000 | Blocker |
| 6,332,586 | B1 | 12/2001 | Risa et al. |

FOREIGN PATENT DOCUMENTS

| | | | |
|---|---|---|---|
| CA | 2122645 | | 4/1995 |
| CA | 2146470 | | 10/1996 |
| CA | 2316846 | | 7/1999 |
| CH | 657 884 | A5 | 9/1986 |
| DE | 34 28 664 | A1 | 2/1986 |
| DE | 40 16 208 | A1 | 11/1991 |
| DE | 42 21 870 | A1 | 1/1994 |
| DE | 196 12 278 | A1 | 11/1996 |
| DE | 197 04 172 | A1 | 8/1998 |
| DE | 198 35 587 | A1 | 2/2000 |
| DE | 199 22 023 | A1 | 11/2000 |
| DE | 101 24518 | A1 | 11/2002 |
| EP | 0 829 274 | A1 | 3/1998 |
| EP | 1 048 326 | A2 | 11/2000 |
| FR | 2 691 366 | A1 | 11/1993 |
| FR | 2 768 419 | A1 | 3/1999 |
| FR | 2 781 383 | A1 | 1/2000 |
| GB | 150642 | | 9/1920 |
| GB | 265004 | | 2/1927 |
| GB | 344704 | | 3/1931 |
| GB | 346270 | | 4/1931 |
| GB | 361802 | | 11/1931 |
| GB | 362607 | | 12/1931 |
| GB | 371130 | | 4/1932 |
| GB | 375546 | | 6/1932 |
| GB | 384787 | | 12/1932 |
| GB | 475781 | | 11/1937 |
| GB | 528149 | | 10/1940 |
| GB | 533421 | | 2/1941 |
| GB | 546813 | | 7/1942 |
| GB | 550506 | | 1/1943 |
| GB | 554711 | | 7/1943 |
| GB | 554907 | | 7/1943 |
| GB | 561699 | | 5/1944 |
| GB | 756878 | | 9/1956 |
| GB | 761670 | | 11/1956 |
| GB | 873628 | | 7/1961 |
| GB | 887291 | | 1/1962 |
| GB | 943416 | | 12/1963 |
| GB | 2 326 082 | A | 12/1998 |
| GR | 870102020 | | 7/1988 |
| JP | 7-163673 | | 6/1995 |
| JP | 9-135918 | | 5/1997 |
| JP | 9-173493 | | 7/1997 |
| JP | 9-220294 | | 8/1997 |
| JP | 9-271529 | | 10/1997 |
| JP | 9-308702 | | 12/1997 |
| JP | 10-137356 | | 5/1998 |
| JP | 10-263103 | | 10/1998 |
| JP | 10-314330 | | 12/1998 |
| JP | 11-9716 | | 1/1999 |
| JP | 11-47303 | | 2/1999 |
| JP | 11-47304 | | 2/1999 |
| JP | 11-128385 | | 5/1999 |
| JP | 11-155972 | | 6/1999 |
| JP | 2000-37471 | | 2/2000 |
| JP | 2000-296183 | | 10/2000 |
| JP | 2001-9054 | | 1/2001 |
| JP | 2002-173271 | | 6/2002 |
| JP | 2002-186681 | | 7/2002 |
| JP | 2003-93535 | | 4/2003 |
| RU | 2 106 164 | C1 | 3/1998 |
| RU | 2175567 | C2 | 11/2001 |
| WO | WO 98/09681 | | 3/1998 |
| WO | WO 98/57709 | | 12/1998 |
| WO | WO 99/33739 | | 7/1999 |

* cited by examiner

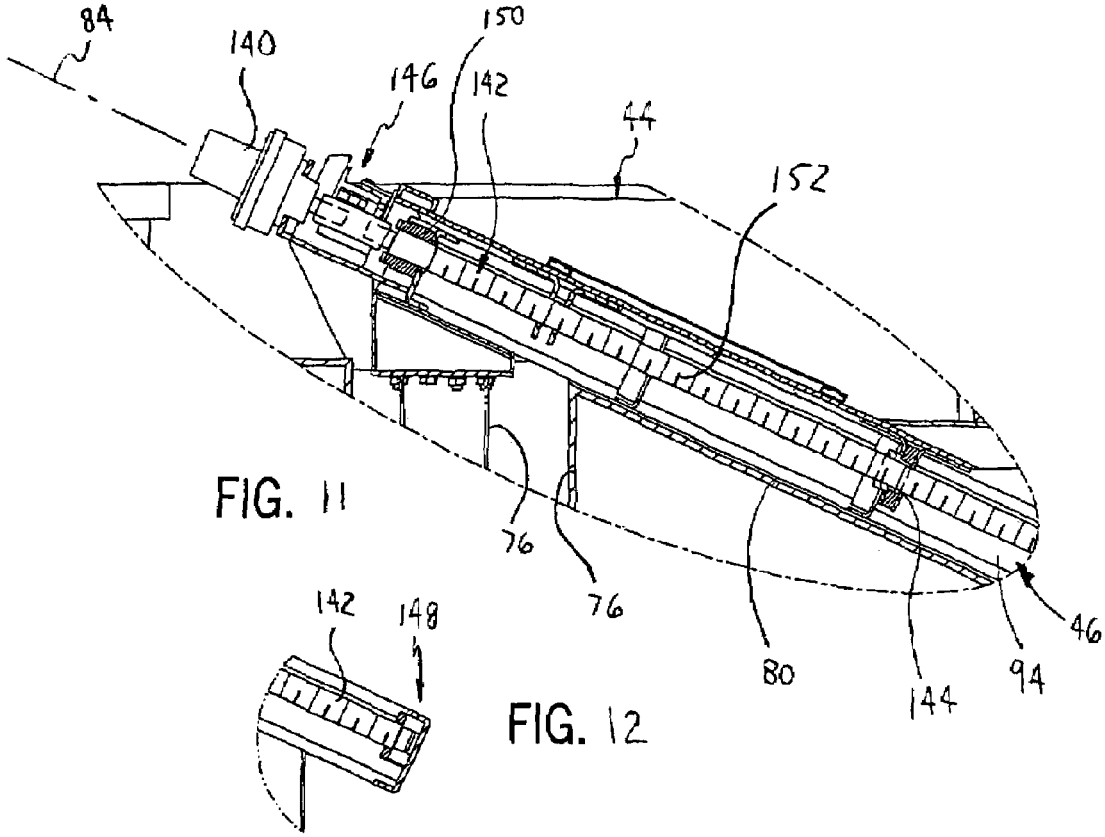
FIG. 11
FIG. 12
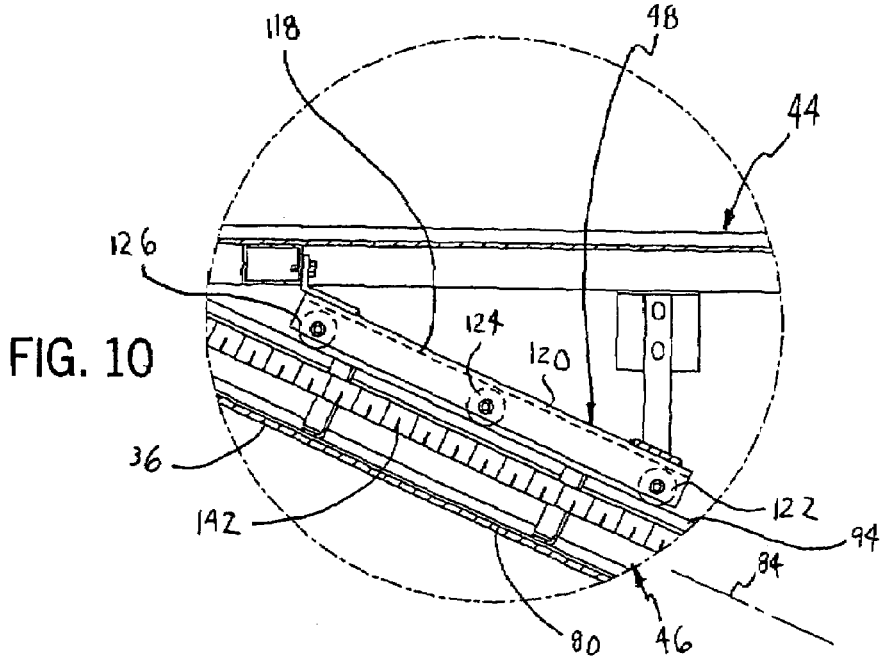
FIG. 10

VEHICULAR STORAGE SYSTEM

BACKGROUND

Storage systems are commonly used on vehicles to store and carry various objects. In many vehicles, especially heavy duty vehicles, storage locations on the vehicle are difficult to access. One example of such a vehicle is a firefighting vehicle, such as a pumper, in which hose is generally stored in a storage structure or bed which is substantially elevated above the ground. As a result, hose deployment and hose reloading is often tedious and time consuming.

BRIEF DESCRIPTION OF THE DRAWINGS

FIG. 10 is an enlarged view of a portion of the storage system of FIG. 2 taken along line 10-10.

FIG. 11 is an enlarged view of a second portion of the storage system of FIG. 2 taken along line 11-11.

FIG. 12 is an enlarged view of a portion of the storage system of FIG. 2 taken along line 12-12.

DETAILED DESCRIPTION OF EXAMPLE EMBODIMENTS

Figure 1:
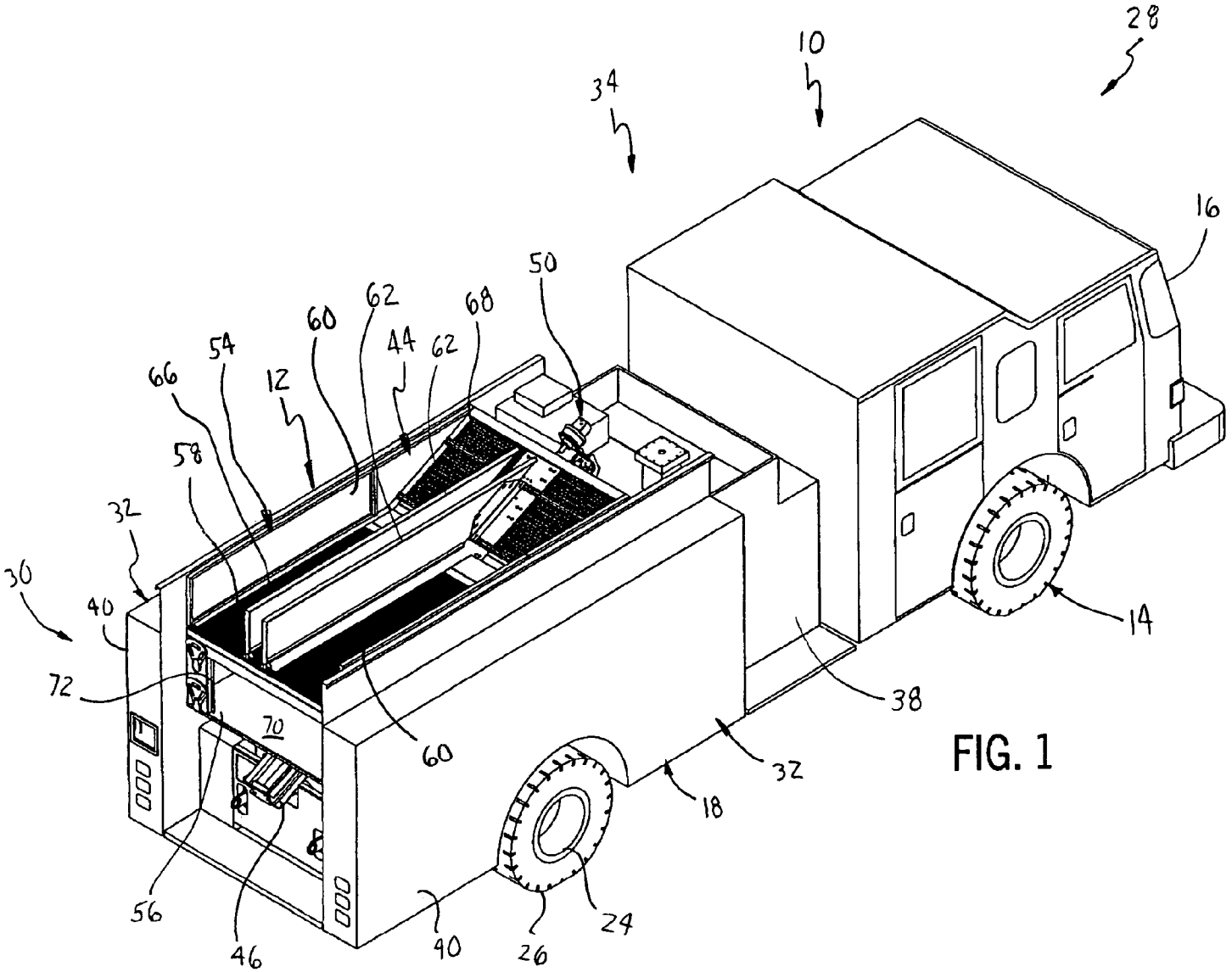
FIG. 1 is a top rear perspective view of a vehicle provided with one example of a vehicular storage system of the present invention.

FIG. 1 is a rear top perspective view of a vehicle 10 provided with vehicular storage system 12. Vehicle 10 is a self-propelled vehicle generally including a chassis 14, cab 16 and rear body 18. Chassis 14 generally includes the functional parts of vehicle 10 such as frame 20 (shown in FIG. 2), suspension (not shown), exhaust system (not shown), brakes (not shown), engine (not shown), transmission (not shown), rear axle 22 (shown in FIG. 2), drive train (not shown), fuel system (not shown), wheels 24 and tires 26. Cab 16 is supported by frame 20 and functions as an occupant compartment for vehicle 10. Body 18 generally comprises one or more additional structures, including panels, supported by frame 20 and configured to form cargo areas as well as to enclose components of the chassis.

Vehicle 10 generally includes a front 28, a rear 30, lateral sides 32 and a top 34. In the particular embodiment illustrated, vehicle 10 comprises a firefighting vehicle configured to supply and deliver a firefighting agent, such as water, foam or other agents, to a point of interest. In the particular embodiment shown, vehicle 10 specifically comprises a firefighting vehicle commonly referred to as a pumper having a tank 36 (shown in FIG. 2) and a pump house 38. Tank 36 comprises one or more structures configured to contain a firefighting agent. Pump house 38 comprises a housing or framework supporting a pump and controls for operating the pump to the fluid or firefighting agent from tank 36 through nozzles or hoses (not shown).

Vehicular storage system 12 comprises a system configured to provide a movable storage volume for vehicle 10. In particular, system 12 provides a storage volume which moves between an elevated position (shown in FIG. 1) and a lowered position providing improved ergonomic access to the storage volume. In the embodiment illustrated, storage system 12 is situated proximate to rear 30 of vehicle 10 between opposing side portions 40 of body 18. Vehicle storage system 12 generally includes storage structure 44, guide 46, interface 48 (shown in FIG. 2) and actuator 50. Storage structure 44 provides a storage space for system 12 and includes bed 54 and compartment 56. Bed 54 generally provides an open topped structure upon which objects may be rested. In the particular embodiment shown in which storage system 12 is provided as part of vehicle 10 comprising a pumper, bed 54 is configured to store firefighting hose. According to one embodiment, bed 54 has a longitudinal length of at least 60 inches. In the embodiment shown, bed 54 has a longitudinal length of approximately 120 inches and a width of approximately 66 inches. Bed 54 is configured to hold 1500 feet of 5-inch hose.

Bed 54 generally includes a floor 58, sidewalls 60 and divider walls 62. Floor 58 provides the surfaces upon which hose or other objects rest. In one embodiment, floor 58 is perforated so as to permit water to drain from objects, such as hose, stored upon floor 58. In one embodiment, floor 58 is formed from a plurality of spaced horizontal longitudinal rungs or bars. In other embodiments, other forms of perforations may be used. Floor 58 includes a generally flat horizontal portion 66 and a sloped or inclined forward portion 68. Portion 68 extends from portion 66 and enables bed 54 to provide a greater storage volume by extending the volume of bed 54 further towards front 28. Sidewalls 60 and divider walls 62 partition the volume of bed 54. As shown by FIG. 1, floor 58, sidewalls 60 and divider walls 62 form an open-topped, open-ended volume, enabling hose or other things to be easily lifted from bed 58 or removed through the open end of bed 58.

Compartment 56 comprises a secondary storage volume hanging or suspended from bed 54 below floor 58. Compartment 56 has a lower secondary floor 70 onto which objects may be stored and supported. Compartment 56 has a rearward opening 72 for facilitating insertion of articles into compartment 56. Compartment 56 includes a door 73 closing opening 72. In other embodiments, compartment 56 may be omitted from storage structure 44.

Figure 2:
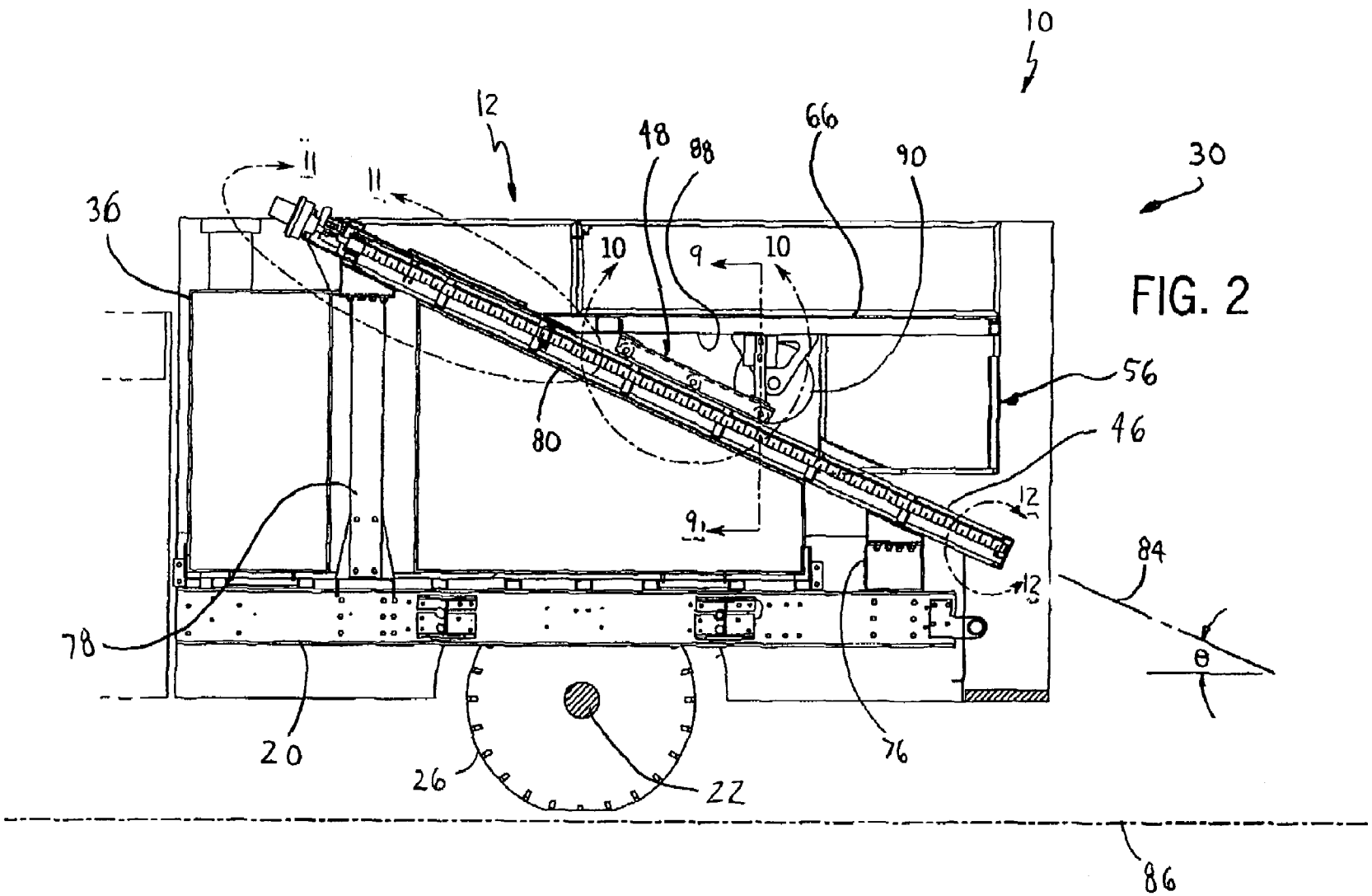
FIG. 2 is a sectional view of a rear portion of the vehicle of FIG. 1 illustrating the storage system in a raised position.
Figure 3:
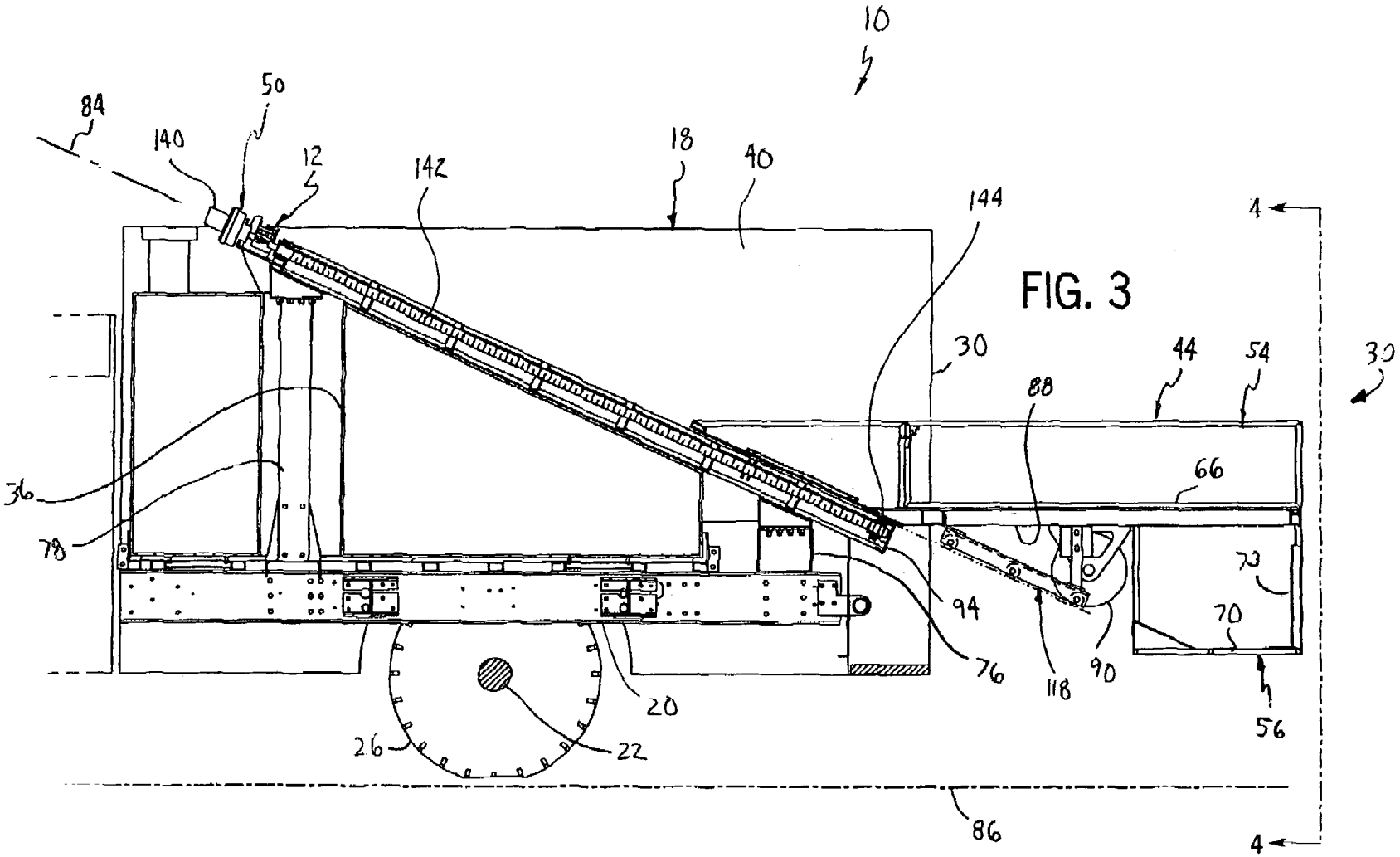
FIG. 3 illustrates the vehicle of FIG. 2 with the storage system in a lowered position.

Guide 46 guides or directs the movement of storage structure 44 relative to vehicle 10. FIGS. 2 and 3 illustrate the orientation of guide 46 and its guided movement of storage structure in greater detail. As shown by FIGS. 2 and 3, guide 46 is coupled to frame 20 by supports 76 and 78. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

As shown by FIGS. 2 and 3, supports 76 and 78 cooperate to elevate guide 46 at an inclined angle. Support 76 has a shorter height and is generally located proximate to rear 30 while support 78 has a greater height and is located distant rear 30. Support 78 supports guide 46 and storage structure 44 above tank 36 when storage structure 44 is in a raised position.

As shown by FIGS. 2 and 3, tank 36 extends below guide 46 and has an inclined outer surface 80. Because surface 80 is inclined, surface 80 enables tank 36 to more fully occupy space below guide 46 and storage structure 44, increasing the storage capacity of tank 36. In the particular embodiment, tank 36 has a storage volume of at least 300 gallons. To further increase its storage capacity, tank 36 additionally extends at least 180 degrees about support 78. In the particular embodiment shown, tank 36 completely surrounds or extends about support 78 and forward guide 46. In the particular embodiment shown, tank 36 is configured to contain approximately 900 gallons of water and 30 gallons of foam.

Figure 4:
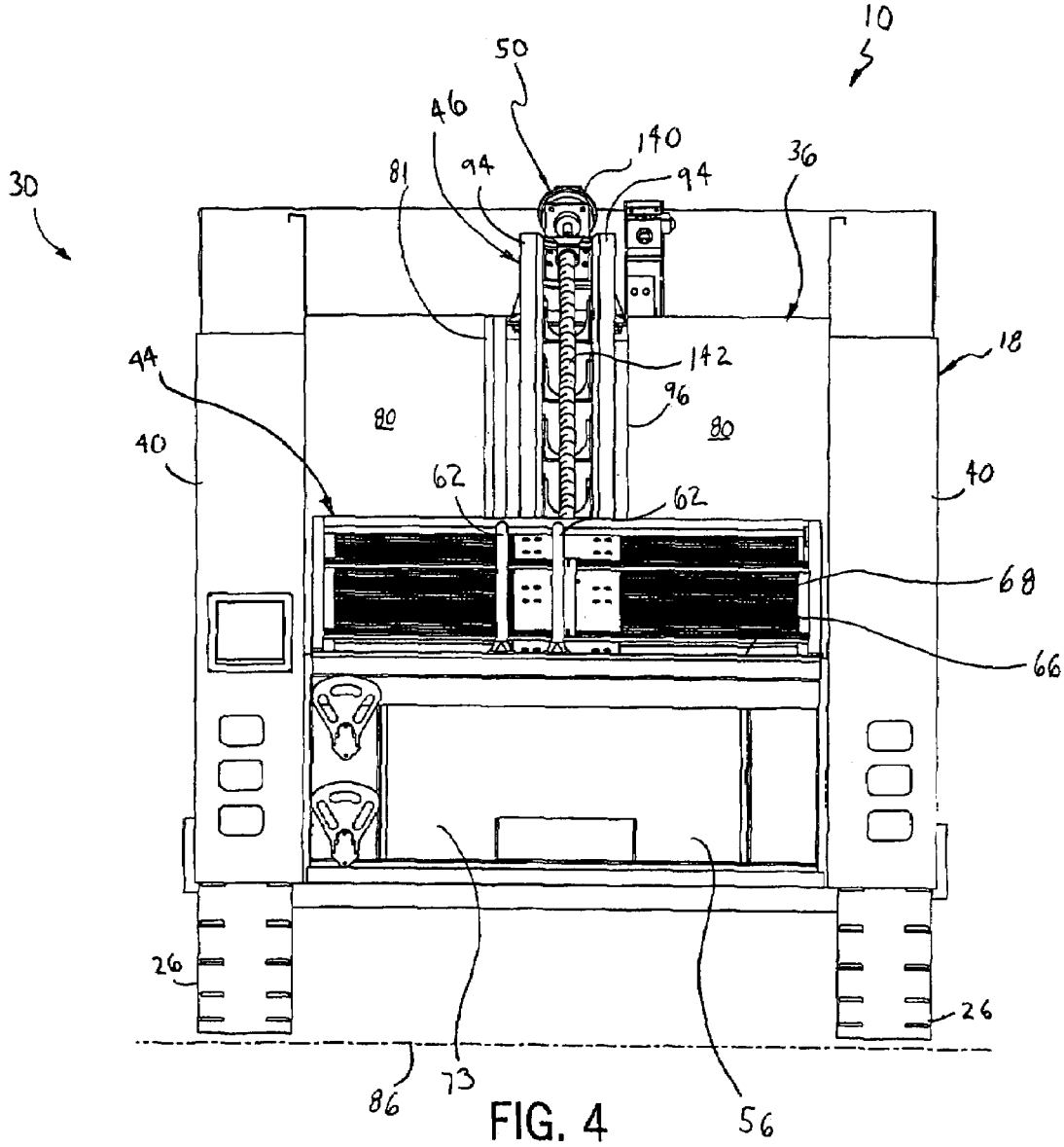
FIG. 4 is a right-end elevational view of the vehicle of FIG. 3 taken along line 4-4.
Figure 7:
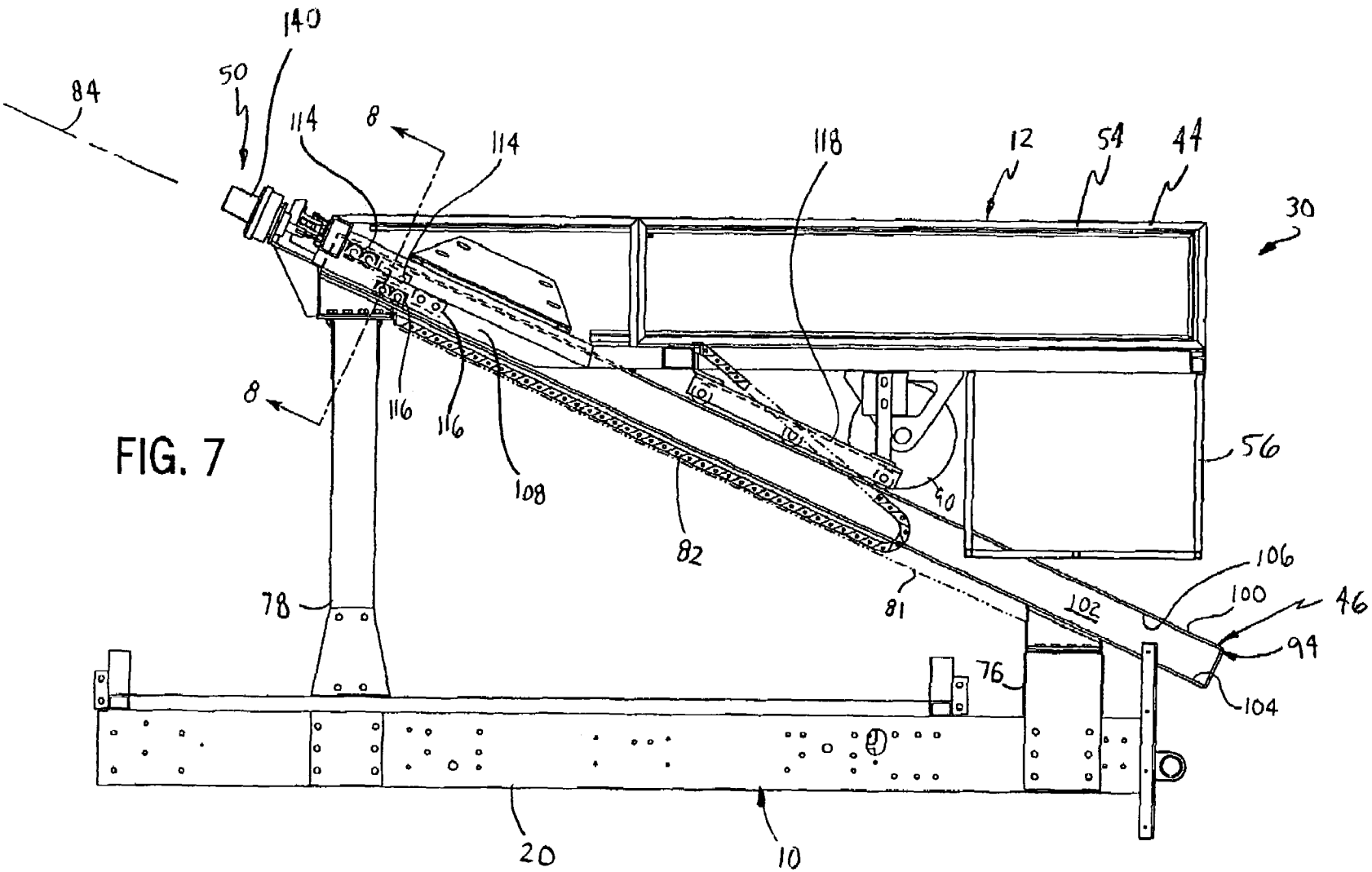
FIG. 7 is a side elevational view of the frame and storage system of FIG. 6 further illustrating an extendable conduit coupled to the system.

As further shown by FIGS. 4 and 7, surface 80 of tank 36 additionally includes recess 81 which receives other components of storage system 12. In the particular embodiment illustrated, recess 81 comprises a groove in which an electrical conduit 82 supplied by Gleason Reel Corporation and used to house wires or hydraulic or pneumatic houses. In the particular embodiment illustrated, the conduit (commonly known as E-Z track) houses electrical wires facilitating the transmission of power to marker lights on storage structure 44 (not shown) and electrical rewind motors (not shown) for reels 90. Recess 81 further enables storage structure 44 to more closely follow surface 80, facilitating a more compact arrangement. Recess 81 further assists in preventing conduit 82 from becoming entangled during repeated raising and lowering of storage structure 44.

As shown by FIGS. 2 and 3, guide 46 guides movement of storage structure 44 between a raised position (shown in FIGS. 1 and 2) and a lowered position (shown in FIGS. 3 and 4). In the raised position, storage structure 44 extends above tank 36 and is forward rear 30 of vehicle 10. As a result, tank 36 is located lower upon vehicle 10, providing vehicle 10 with a lower center of gravity. In the embodiment shown, guide 46 extends along a linear inclined axis 84 such that storage structure 44 also moves along the linear axis 84 for at least a portion of time while moving between the raised position and the lowered position. In the particular embodiment shown, all movement of storage structure 44 between the raised position and the lowered position is along axis 84. Axis 84 is at an angle θ with respect to the horizontal. In one embodiment, angle θ is at least 20 degrees and no greater than 45 degrees. In the particular embodiment shown, vehicle 10 is a long body pumper, wherein rear body 18 has a longitudinal length extending from a rear of pump house 38 (shown in FIG. 1) to a rear 30 of vehicle 10 of approximately 181 inches. In the particular long body shown, angle θ is at least 20 degrees and no greater than 30 degrees. As a result, the longitudinal length and storage capacity as well as the volume of tank 36 are optimized while ensuring that bed 54 may be sufficiently lowered to provide ergonomic access to a hose or other objects stored within bed 54. In the particular embodiment shown, angle θ is approximately 24.5 degrees. As a result, floor 58 is approximately 96 inches above ground 86 when in the raised position shown in FIGS. 1 and 2 and is approximately 44 inches above ground 86 when in the lowered position shown in FIGS. 3 and 4. Floor 70 of compartment 56 is no greater than 15 inches off of ground 86 and is approximately 13 inches off of the ground 86 when storage structure 44 is in the lowered position. In other embodiments, floor 70 may be supported at other heights relative to ground 86. When in the lowered position, a majority of a longitudinal length of bed 54 projects rearwardly from rear 30 of vehicle 10. In particular, storage structure 44 extends at least 60 inches rearwardly from rear 30. In the embodiment shown, storage structure 44 extends approximately 87 inches from rear 30 of vehicle 10.

As further shown by FIGS. 2-4, during its movement from the raised position to the lowered position, storage structure 44 remains in a substantially horizontal orientation. In particular, floor 70 and floor portion 66 extend in substantially horizontal planes as storage structure 44 moves along axis 84. As a result, objects or articles resting upon floor 70 and floor portion 66 remain relatively stationary and are not moved under the force of gravity. In alternative embodiments, storage structure 44, floor portion 66 and floor 70 may alternatively be inclined.

As shown by FIG. 2, storage structure 44 has a general sideways L-shape provided by bed 54 and compartment 56. As a result, storage structure 44 occupies a greater majority of the rear face of vehicle 10 when in the raised position. At the same time, the interior cavity or opening 88 formed between compartment 56 and an underside of floor portion 66 is utilized. In particular, additional accessories are mounted to an underside of floor portion 66 forward of compartment 56. Such accessories straddle or extend on opposite lateral sides of guide 46. In the particular embodiment shown, system 12 includes a pair of reels 90 suspended below floor portion 66 in cavity 88. Reels 90 are configured to carry pneumatic or hydraulic hose for powering hydraulic or pneumatic tools such as spreaders and cutters used in auto accidents. In other embodiments, other accessories may be mounted or suspended in cavity 88 either to an underside of floor portion 66 or to a wall of compartment 56.

Figure 5:
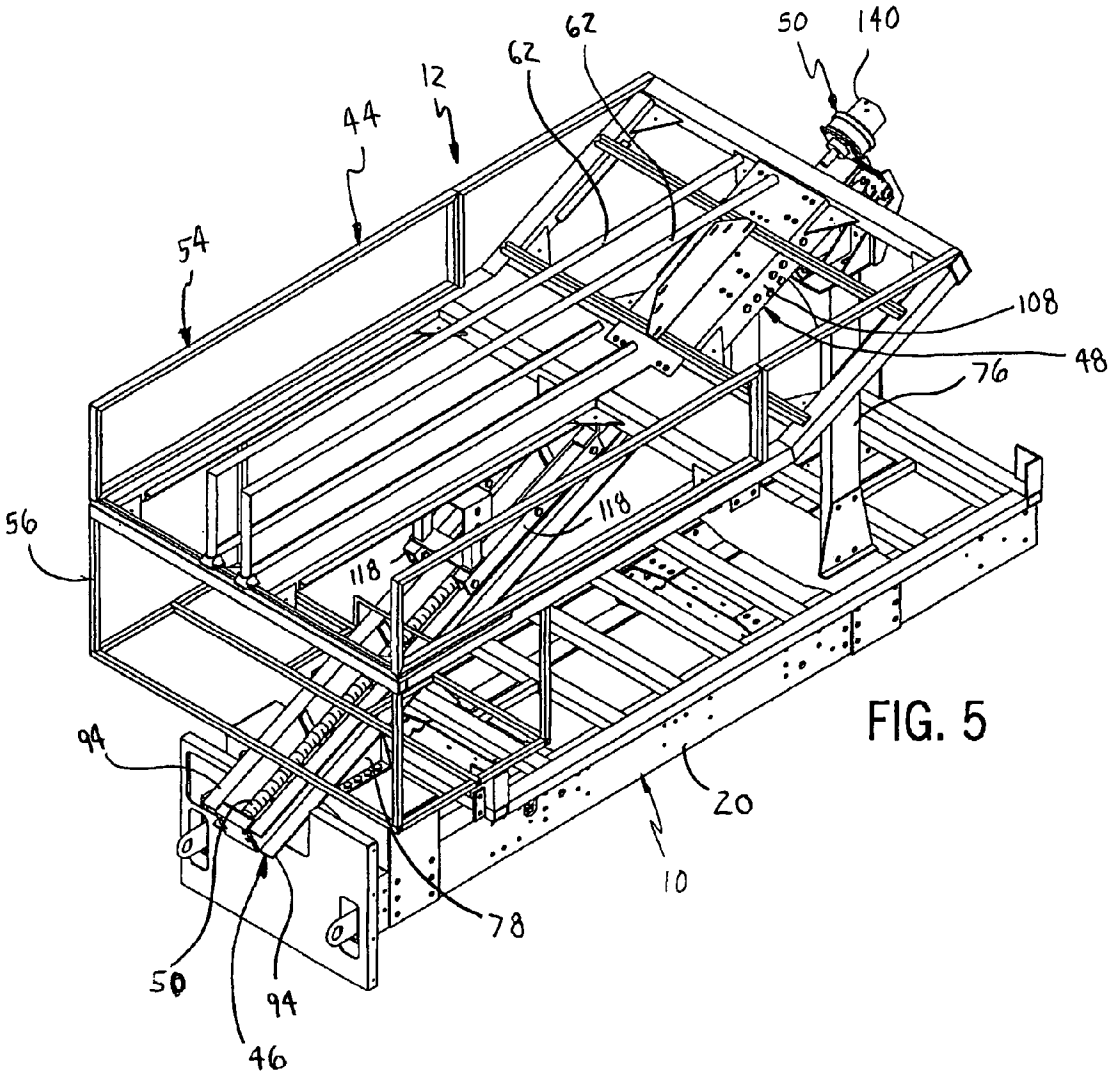
FIG. 5 is a top rear perspective view of the storage system of FIG. 1 coupled to a frame of the vehicle of FIG. 1 with major surfaces and panels of the storage system omitted for purposes of illustration.
Figure 6:
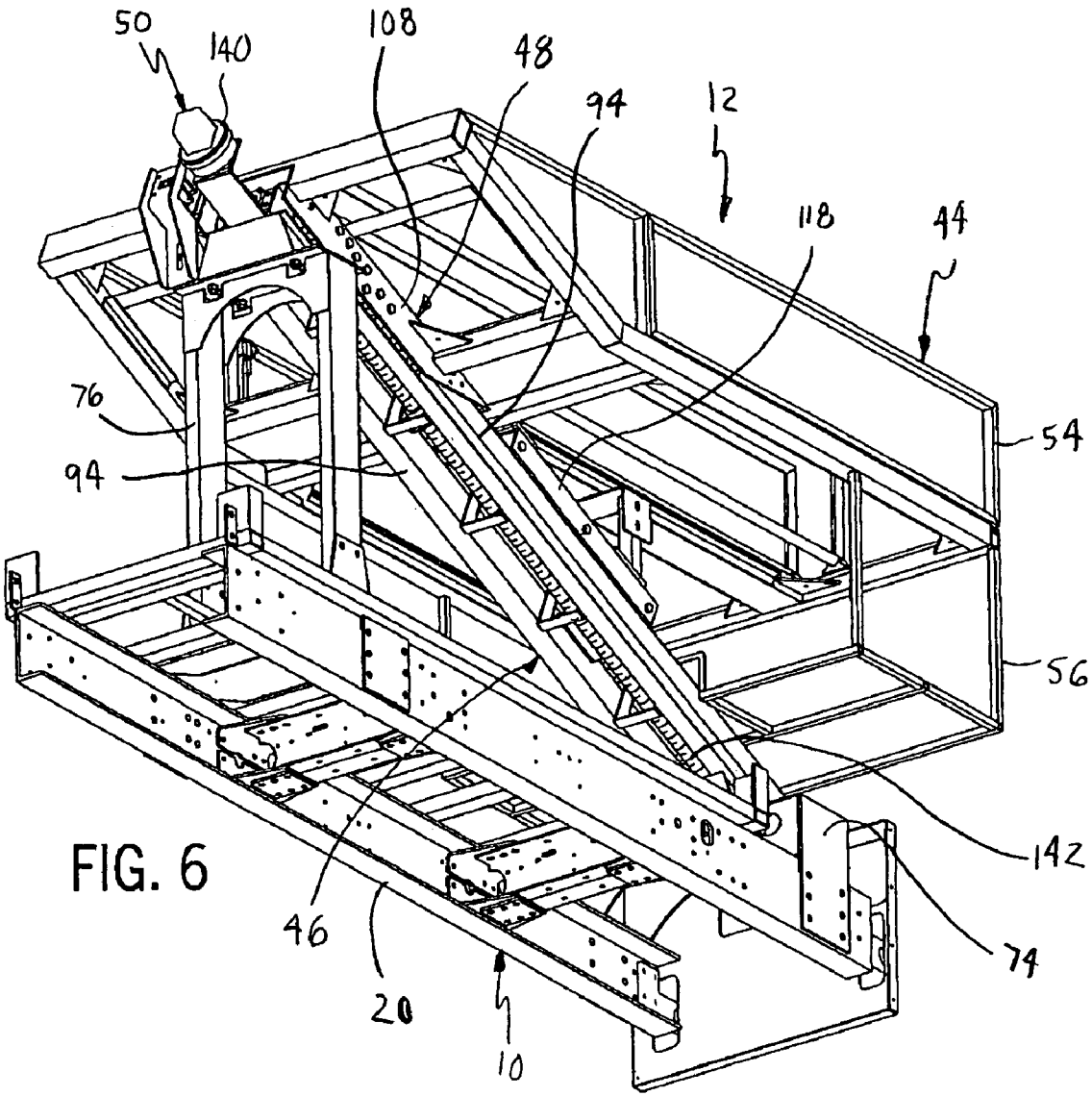
FIG. 6 is a front bottom perspective view of the storage system and frame of FIG. 5.
Figure 9:
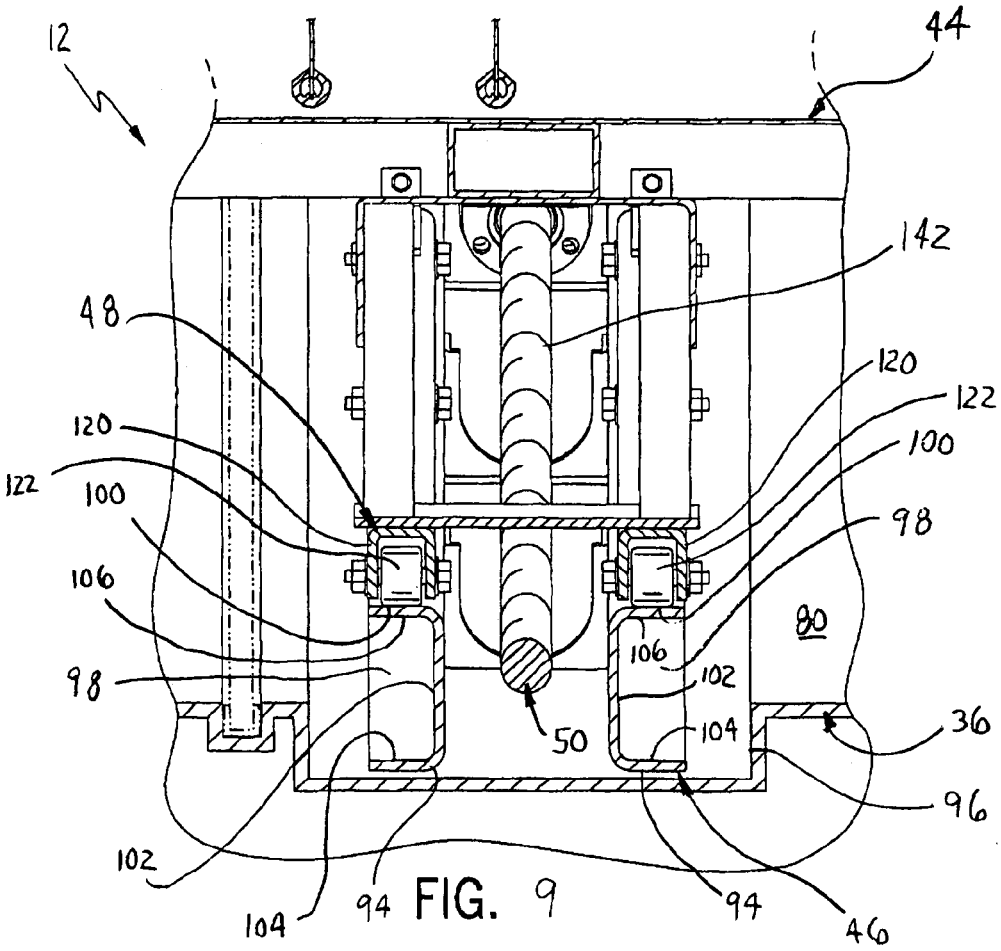
FIG. 9 is an enlarged fragmentary sectional view of the storage system of FIG. 2 taken along line 9-9.

FIGS. 5, 6 and 9 illustrate guide 46 in greater detail. To better illustrate guide 46, FIGS. 5 and 6 merely illustrate frame 20 of vehicle 10 and illustrate only the general framework of storage structure 44, omitting major panels and walls of storage structure 44. As shown by FIGS. 5, 6 and 9, in the particular embodiment illustrated, guide 46 generally includes a pair of spaced rails 94 extending along axis 84 (shown in FIG. 2). Rails 94 are coupled to supports 76 and 78 and generally straddle portions of actuator 50. As shown by FIG. 9, rails 94 are partially received within a recessed channel 96 formed within inclined surface 80 of tank 36. As a result, the lower surface of storage structure 44 closely follows surface 80 to increase the height and storage capacity of tank 36 while minimizing the height at which storage structure 44 extends when in the raised position and maintaining the overall maximum height of vehicle 10.

As shown by FIG. 9, each rail 94 includes a generally C-shaped channel 98 facing in an outward direction and a track or surface 100. Each channel 98 includes an outwardly facing surface 102, an upwardly facing surface 104 and a downwardly facing surface 106. As will be described in greater detail hereafter, surfaces 100, 102, 104 and 106 interact with interface 48 to guide movement of storage structure 44. In other embodiments, guide 46 may alternatively include a single rail or greater than two rails. Guide 46 may also have various alternative structures configured to movably support storage structure 44 along axis 84, or along other paths, between the raised position and the lowered position depending upon the exact configuration of storage structure 44, the particular configuration of interface 48 and the particular configuration of actuator 50.

Figure 8:
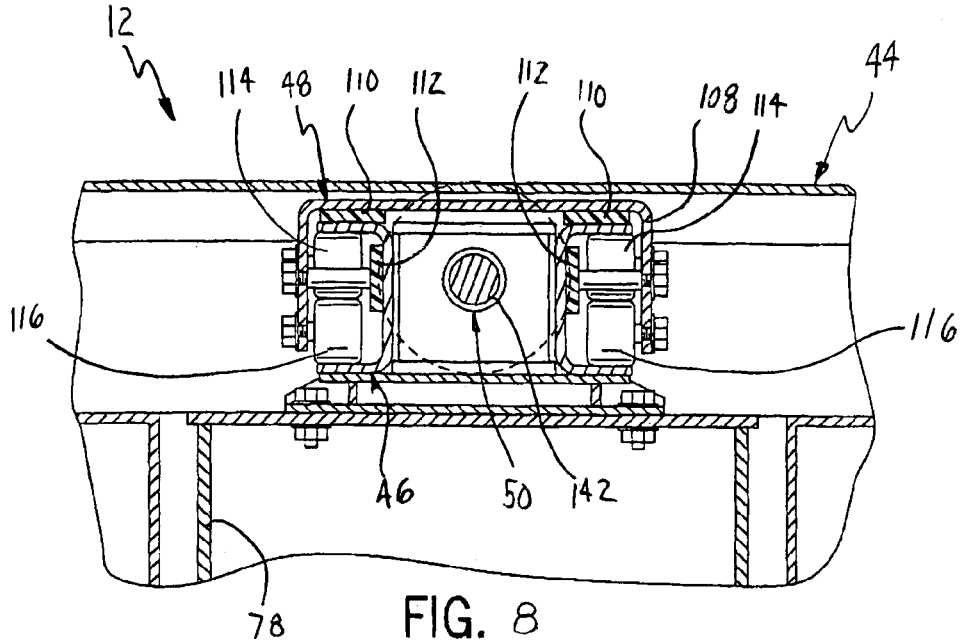
FIG. 8 is a fragmentary sectional view of the storage system of FIG. 7 taken along line 8-8.

Interface 48 is coupled to storage structure 44 and engages guide 46 to direct movement of storage structure 44 along axis 84. FIGS. 7-9 illustrate one embodiment of interface 48 interacting with one embodiment of guide 46. As shown by FIG. 7, interface 48 includes slider body 108, top slider pads 110 (shown in FIG. 8), side slider pads 112 (shown in FIG. 8), upper rollers 114, lower rollers 116 and skates 118. Slider body 108 is coupled to storage structure 44 and extends about both of rails 94. Slider body 108 supports top slider pads 110, side slider pads 112, upper rollers 114 and lower rollers 116 in engagement with both of rails 94. In alternative embodiments, interface 48 may be provided with multiple bodies 108 coupled to storage structure 44 and supporting one or more of pads 110, 112 or rollers 114, 116.

Top pads 110 are coupled to an underside of body and are in slidable engagement with top surface 100 of rails 94. Slider pads 112 are coupled to body 108 and engage surfaces 102 of rails 94. Pads 110 and pads 112 are formed from a low friction material to facilitate sliding while stabilizing body 108 and storage structure 44 along rails 94. In one particular embodiment, pads 110 and pads 112 are formed from ultra-high molecular weight polyethylene. In other embodiments, slider pads 110 and 112 may be formed from different materials.

Upper rollers 114 extend within channels 98 of each of rails 94 and are rotatably coupled to body 108 while engaging upper surfaces 106 of rails 94. In the particular embodiment shown, upper rollers 114 each include a pair of rollers rotating against surface 106 of each of rails 94. Lower rollers 116 comprise roller wheels rotatably coupled to body 108 in engagement with lower surface 104 within channel 98 of each of rails 94. In the particular embodiment illustrated, upper rollers 114 and lower rollers 116 along each rail 94 are longitudinally spaced from one another for improved stability. In the particular embodiments shown, upper rollers 114 and lower rollers 116 are each longitudinally spaced from one another by approximately 14 inches. Upper rollers 114 and lower rollers 116 provide low friction interfaces between body 108 (and storage structure 44) and rails 94.

In the embodiment shown, lower rollers 116 each include a pair of rollers. In other embodiments, lower rollers 116 may include a single roller or greater than two rollers. Likewise, in other embodiments, upper rollers 114 may alternatively include a single roller or greater than two rollers. In still other embodiments, one or more of upper rollers 114 or lower rollers 116 may alternatively be replaced with other low friction interface mechanisms such as pads. Likewise, in other embodiments, pads 110 and pads 112 may alternatively be replaced with other low friction interface mechanisms such as rollers.

FIGS. 9 and 10 illustrate skates 118 in greater detail. As shown by FIG. 10, each skate 118 includes a body 120 and a plurality of rollers 122, 124 and 126. Each body 120 is coupled to storage structure 44 and extends generally parallel to rails 94 along axis 84. As shown by FIG. 7, each skate 118 is longitudinally spaced from body 108, pads 110, 112 and rollers 114, 116 towards rear 30 of vehicle 10.

Rollers 122, 124 and 126 are rotatably supported by body 120 and each ride or roll upon surface 100 of their respective rails 94. As a result, skates 118 provide a low friction interface along surfaces 100 of rails 94 to support and stabilize movement of support structure 44. As shown by FIG. 3, rollers 122, 124 and 126 roll off of ends of rails 94 when storage structure 44 is in the lowered or extended position. To facilitate repositioning of skates 118 upon rails 94 when support structure 44 is moved upward from the lowered position to the raised position, each of rollers 122, 124 and 126 are vertically staggered relative to one another. In particular, roller 126 projects below body 120 by a first distance, roller 124 projects below body 120 by a second greater distance and roller 122 projects below body 120 by a third distance greater than the second distance. In the particular embodiment illustrated, roller 124 projects below body 120 by an additional $\frac{1}{8}^{th}$ of an inch as compared to roller 126 and roller 122 projects below body 120 by an additional $\frac{1}{8}^{th}$ of an inch as compared to roller 124. In alternative embodiments, rollers 122, 124 and 126 may have equal relative ride heights. In other embodiments, skates 118 may alternatively include a greater than three or fewer than three such rollers. In still other embodiments, skates 118 may utilize other low friction interface mechanisms such as low friction pads and the like in engagement with rails 94 or other structures serving as guide 46.

Actuator 50 comprises a powered mechanism configured to move storage structure 44 between the raised position and the lowered position. In the particular embodiment shown, actuator 50 includes motor 140, screw 142 and follower 144. Motor 140 comprises a mechanism configured to rotatably drive screw 142. In the particular embodiment illustrated, motor 140 comprises a hydraulic motor having an appropriately configured manifold enabling motor 140 to drive screw 142 in forward and reverse directions. In the particular embodiment illustrated, motor 140 comprises an 11-horsepower white hydraulic motor. In other embodiments, motor 140 may comprise other motors such as electric motors, pneumatic motors, engine-driven motors and the like.

Screw 142 is coupled to motor 140 at a first end 146 and is journaled at a second end 148 (shown in FIG. 12). Screw 142 is further rotatably supported by bearings or bushings 150 at one or more locations along its axial length. Screw 142 includes exterior threads 152 in meshing engagement with follower 144. In the particular embodiment illustrated, screw 142 comprises a two-inch Acme lead screw.

Follower 140 comprises a structure coupled to storage structure 44 by interface 48 and further meshing with threads 152 of screw 142. In alternative embodiments, follower 144 may be directly coupled to storage structure 44. Rotation of screw 142 by motor 140 causes follower 144 to move up or down along the longitudinal axis 84 of screw 142.

In other embodiments, actuator 50 may have other configurations. For example, in other embodiments, actuator 50 may alternatively utilize one or more hydraulic or pneumatic piston-cylinder assemblies configured to move storage structure 44 between the raised position and the lowered position along axis 84 or along alternative paths. In still other embodiments, a pinion gear in meshing engagement with a rack gear coupled to storage structure 44 may be rotatably driven to raise and lower storage structure 44. In still another embodiment, storage structure 44 may be raised or lowered by winding or unwinding a belt, cable or chain or by moving a belt, cable or chain.

Overall, vehicle storage system 12 provides a system for storing objects or articles in a raised position, accommodating other structures of a vehicle that may benefit from a lower storage elevation, and a lowered position, permitting such objects or articles to be easily accessed, loaded or unloaded. At the same time, vehicular storage system 12 is relatively compact and modular, enabling system 12 to be built as a separate modular unit and to be mounted to existing vehicles. As described above, vehicular storage system 12 is particularly suited for use in a firefighting vehicle such as pumper. In one embodiment, storage system 12 provides sufficient storage space for storing fire hoses. At the same time, storage system 12 extends above the tank of a firefighting vehicle, enabling the tank to have a lower position in the vehicle, providing the vehicle with a lower center of gravity. Because the tank extends below the storage structure, the storage capacity of the tank is increased. Although these features and other features set forth above are illustrated as being combined and utilized in a single vehicle 10, such features may alternatively be used independent of one another or in alternative vehicles having other storage requirements.

Although the present invention has been described with reference to preferred embodiments, workers skilled in the art will recognize that changes may be made in form and detail without departing from the spirit and scope of the invention. For example, although different preferred embodiments may have been described as including one or more features providing one or more benefits, it is contemplated that the described features may be interchanged with one another or alternatively be combined with one another in the described preferred embodiments or in other alternative embodiments. Because the technology of the present invention is relatively complex, not all changes in the technology are foreseeable. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A firefighting apparatus comprising:
a vehicle;
a tank configured to carry a firefighting agent; and
a storage structure movable between a raised position above the tank and a lowered position;
wherein the storage structure extends beyond a rear of the vehicle in the lowered position.

2. The apparatus of claim 1, wherein the storage structure extends along a top of the vehicle when in the raised position.

3. The apparatus of claim 1, wherein the storage structure has a lower most floor no greater than 15 inches above ground when in the lowered position.

4. The apparatus of claim 1, wherein the storage structure has an upper most floor no greater than 50 inches above ground when in the lowered position.

5. A firefighting apparatus comprising:
a vehicle;
a tank configured to carry a firefighting agent; and
a storage structure movable between a raised position above the tank and a lowered position;
wherein the storage structure moves along a linear axis from the raised position to the lowered position.

6. The apparatus of claim 5, wherein the linear axis is inclined.

7. The apparatus of claim 5, wherein the tank has an inclined outer surface along the axis.

8. The apparatus of claim 7 including a guide configured to guide movement of the storage structure between the raised position and the lowered position.

9. The apparatus of claim 8 including a support elevating the guide, wherein the tank extends at least 180 degrees about the support.

10. The apparatus of claim 8, wherein the inclined surface includes a channel at least partially receiving the guide.

11. The apparatus of claim 8, wherein the storage structure laterally projects beyond the guide.

12. The apparatus of claim 11 including at least one accessory carried by the storage structure on at least one lateral side of the guide.

13. The apparatus of claim 7, wherein the inclined surface includes at least one recess into which other components of the apparatus are received.

14. A firefighting apparatus comprising:
a vehicle;
a tank configured to carry a firefighting agent; and
a storage structure movable between a raised position above the tank and a lowered position; and
a powered actuator configured to move the storage structure between the raised position and the lowered position.

15. The apparatus of claim 14, wherein the powered actuator includes:
a motor;
a screw rotatably driven by the motor; and
a follower coupled to the storage structure and in engagement with the worm gear.

16. A firefighting apparatus comprising:
a vehicle;
a tank configured to carry a firefighting agent; and
a storage structure movable between a raised position above the tank and a lowered position; and
an inclined guide configured to guide movement of the storage structure between the raised position and the lowered position.

17. The apparatus of claim 16, wherein the guide includes an outwardly facing surface and wherein the apparatus includes an interface having a pad slidably engaging the surface.

18. The apparatus of claim 16, wherein the guide includes a first upwardly facing surface and wherein the apparatus includes an interface having at least one first roller engaging the first surface.

19. The apparatus of claim 18, wherein the guide includes a secondly downwardly facing surface and wherein the apparatus includes an interface having at least one second roller engaging the second surface.

20. A firefighting apparatus comprising:
a vehicle;
a tank configured to carry a firefighting agent; and
a storage structure movable between a raised position above the tank and a lowered position;
wherein the storage structure includes a bed floor and wherein the apparatus further includes at least one reel rotatably supported by the storage structure below the bed floor.

21. A firefighting apparatus comprising:
a vehicle;
a tank configured to carry a firefighting agent; and
a storage structure movable between a raised position above the tank and a lowered position;
wherein the storage structure moves along an inclined linear axis for at least a portion of time while moving between the raised position and the lowered position.

22. The apparatus of claim 21, wherein the linear axis is between about 20 degrees and about 45 degrees relative to horizontal.

23. The apparatus of claim 21, wherein the linear axis is between about 20 degrees and about 30 degrees relative to horizontal.

24. The apparatus of claim 23, wherein the linear axis is about 25 degrees relative to horizontal.

25. The apparatus of claim 21, wherein the linear axis is at least 20 degrees relative to horizontal.

26. The apparatus of claim 21, wherein the linear axis is no greater than about 30 degrees relative to horizontal.

27. The apparatus of claim 21, wherein the storage structure is configured to be in a substantially horizontal orientation while moving between the raised position and the lowered position.

28. The apparatus of claim 21, wherein the storage structure includes a bed floor and a compartment below the bed floor.

29. A firefighting apparatus comprising:

a vehicle;

a tank configured to carry a firefighting agent; and a storage structure movable between a raised position above the tank and a lowered position;

wherein the storage structure includes a substantially horizontal floor portion and an inclined floor portion extending from the horizontal floor portion.

30. The apparatus of claim 29, wherein the storage structure is configured to store hose.

31. The apparatus of claim 29, wherein the tank is configured to hold at least 300 gallons of firefighting agent.

32. The storage structure of claim 29, wherein the storage structure has a length of at least about 60 inches.

33. The apparatus of claim 29, wherein the storage structure projects at least 60 inches from a rear of the vehicle when in the lowered position.

34. The apparatus of claim 29, wherein the storage structure includes a perforated floor.

35. A firefighting apparatus comprising:

a vehicle having a rear; and a storage structure movable along an inclined axis between a raised position forward the rear of the vehicle and a lowered position.

36. The apparatus of claim 35, wherein the storage structure is supported in a substantially horizontal orientation while moving between the raised position and the lowered position.

37. The apparatus of claim 35, wherein the storage structure projects beyond the rear of the vehicle when in the lowered position.

38. The apparatus of claim 37, wherein the storage structure extends along a top of the vehicle when in the raised position.

39. The apparatus of claim 35, wherein the storage structure extends along a top of the vehicle when in the raised position.

40. The apparatus of claim 35 including a tank configured to contain a firefighting agent, wherein the storage structure is higher than the tank when in the raised position.

41. The apparatus of claim 35 including a powered actuator configured to move the storage structure between the raised position and the lowered position.

42. The apparatus of claim 41, wherein the powered actuator includes:

a motor;

a screw rotatably driven by the motor; and a follower coupled to the storage structure and in engagement with the screw.

43. The apparatus of claim 35, wherein the inclined axis is between 20 degrees and about 30 degrees relative to horizontal.

44. The apparatus of claim 35 wherein the inclined axis is at least 20 degrees relative to horizontal.

45. The apparatus of claim 36, wherein the inclined axis is no greater than about 30 degrees relative to horizontal.

46. The apparatus of claim 35, wherein the storage structure has an open exposed top when in the raised position.

47. A method of storing hose on a firefighting vehicle, the method comprising:

moving a floor, upon which hose is resting, along an inclined axis between a raised position in which the floor is forward a rear of the vehicle and a lowered position in which the floor projects beyond the rear of the vehicle.

48. A method for storing hose on a firefighting vehicle, the method comprising:

moving a floor, upon which hose is resting, along an inclined axis between a raised position in which the floor extends over a tank of the vehicle and a lowered position in which the floor extends below a top of the tank of the vehicle.

* * * * *